US007869750B2

(12) United States Patent
Hanashima et al.

(10) Patent No.: US 7,869,750 B2
(45) Date of Patent: Jan. 11, 2011

(54) IMAGE FORMING APPARATUS WITH A PHASE OF A FIRST LOAD TORQUE SUBSTANTIALLY OPPOSITE TO A PHASE OF A SECOND LOAD TORQUE

(75) Inventors: Toru Hanashima, Hyogo (JP); Tomoyoshi Yamazaki, Osaka (JP); Yuuji Meguro, Hyogo (JP); Masafumi Takahira, Osaka (JP); Tatsuo Fukushima, Hyogo (JP); Kimihiro Tanaka, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 387 days.

(21) Appl. No.: 12/068,059

(22) Filed: Feb. 1, 2008

(65) Prior Publication Data

US 2008/0226358 A1 Sep. 18, 2008

(30) Foreign Application Priority Data

Mar. 13, 2007 (JP) ..... 2007-063477

(51) Int. Cl.
*G03G 15/01* (2006.01)
*G03G 15/16* (2006.01)

(52) U.S. Cl. ..... 399/299; 399/298; 399/66

(58) Field of Classification Search ..... 399/66, 399/121, 298, 299, 302, 303, 308, 312, 313
See application file for complete search history.

(56) References Cited

U.S. PATENT DOCUMENTS 6,201,944 B1 * 3/2001 Onuki et al. ..... 399/299

FOREIGN PATENT DOCUMENTS

| | | |
|---|---|---|
| JP | 06-042314 | 2/1994 |
| JP | 07-072720 | 3/1995 |
| JP | 10-142932 | 5/1998 |
| JP | 2002-156844 | 5/2002 |
| JP | 2002-268410 | 9/2002 |
| JP | 2006-089189 | 4/2006 |

* cited by examiner

*Primary Examiner*—David M Gray
*Assistant Examiner*—Rodney Bonnette
(74) *Attorney, Agent, or Firm*—Harness, Dickey & Pierce, P.L.C.

(57) ABSTRACT

A reciprocating-motion converting mechanism includes a cam that rotates around a rotation center; a reciprocating member that is reciprocated due to rotation of the cam; and a pressing unit that presses the reciprocating member to the cam. A first load torque is generated by a load applied at a point of contact of the cam and the reciprocating motion member. A load applying unit applies a load to the cam to generate a second load torque having a phase substantially opposite to a phase of the first load torque.

20 Claims, 4 Drawing Sheets

IMAGE FORMING APPARATUS WITH A PHASE OF A FIRST LOAD TORQUE SUBSTANTIALLY OPPOSITE TO A PHASE OF A SECOND LOAD TORQUE

CROSS-REFERENCE TO RELATED APPLICATIONS

The present application claims priority to and incorporates by reference the entire contents of Japanese priority document 2007-063477 filed in Japan on Mar. 13, 2007.

BACKGROUND OF THE INVENTION

1. Field of the Invention

The present invention relates to an image forming apparatus, such as a printer, a copier, and a facsimile machine.

2. Description of the Related Art

A typical image forming apparatus forms an image in the following manner. That is, an electrostatic latent image is first formed on a photosensitive element, the latent image is then developed into a toner image with a toner, the toner image on the photosensitive element is then transferred onto an intermediate transfer body, and the toner image on the intermediate transfer body is then transferred onto a recording medium, such as a paper sheet, and the image is finally fixed onto the recording medium by application of heat. Generally, a roller is used to carry such an image or a recording medium. The image or the recording medium is carried by the rotation of the roller. To drive the roller to rotate, a drive source such as a motor is connected to the roller via a drive-force transmission mechanism such as a gear or a timing belt.

There has been developed a retracting mechanism capable of retracting an element when the element is not required to form an image, or to carry the image or a recording medium. For example, in the technology disclosed in Japanese Patent Publication No. 3512307, in a multi-color image forming apparatus, when a black image is to be formed, only the element required to form the black image is activated, i.e., elements that are not required for the formation of the black image are retracted. Moreover, in a manual sheet feeding device disclosed in Japanese Patent Application Laid-open No. 2006-089189, a bottom plate is configured to be retracted downward when the manual sheet feeding device is powered OFF, so that a user can easily handle a recording medium. The retracting mechanism typically includes a cam capable of converting a power transmission from a drive source into a reciprocating motion.

Generally, an external force is applied to the reciprocating member by a spring or the like so that the reciprocating member is held in either an operating position or a retracted position as a home position. When the reciprocating member held in the home position moves to some other position due to the rotation of the cam, a force exceeding the external force is applied to the reciprocating member. At this time, a load torque is exerted on a camshaft. Subsequently, when the reciprocating member moves back to the home position from the other position, the external force acts as a drive force to the cam, i.e., the drive force is applied to the cam via the reciprocating member by the action of the external force. At this time, an acceleration torque is exerted on the camshaft. In this manner, because of the reciprocating motion of the reciprocating member between the operating position and the retracted position, the load torque and the acceleration torque are alternately exerted on the camshaft. Such a variation between the load torque and the acceleration torque is referred to as a load variation.

The drive source is set to output a power exceeding the maximum load torque of those exerted on the camshaft. Therefore, even if an average torque of the load torque is identical to that of the acceleration torque, when the load variation between the load torque and the acceleration torque is large, it is necessary to use the drive source capable of outputting a power higher than the maximum load torque. One approach is to modify the shape of the cam or the reciprocating member in a manner that leads to reduction in the amount of the load variation. However, this approach could lead to a decrease in the performance reliability of the cam or the reciprocating member. Moreover, the size and the production costs of the apparatus may increase if the modification results in a complicated configuration of the cam or the reciprocating member.

For example, when a direct current (DC) brush motor without a rotation control function depending on the load variation is used as the drive source, an angular velocity of the DC brush motor varies in synchronization with the load variation. Namely, as the amount of the load variation increases, the angular velocity of the DC brush motor also increases. Therefore, in such a configuration that a mechanism controls the cam to be driven or stop driving by detecting a rotational position of the cam and a position of the reciprocating member, the angular velocity varies depending on a working position. Therefore, as the load variation is getting larger, it is necessary to detect the positions of the cam and the reciprocating member more precisely and to set a control value more accurately.

Furthermore, in a case of the drive source without the rotation control function, a rotation rate of the drive source varies, so that a running sound of the drive source increases and decreases depending on a cycle of the variation of the rotation rate. Thus, a user may feel the running sound as a harsh noise.

Moreover, as described above, in an area in which the acceleration torque is exerted on the camshaft while the cam makes one revolution around the shaft, an acceleration for accelerating the cam or the reciprocating member to move is generated depending on a degree of the acceleration torque or the external force. When the reciprocating member moves back to the home position, the reciprocating member may make a relatively loud impact sound due to the acceleration. Thus, the user may feel the impact sound as a harsh noise. Therefore, for example, an impact absorbing material is provided in a collided portion to reduce the impact sound, or a decelerating material for applying a frictional load or the like to the cam or the reciprocating member in the area in which the acceleration torque is exerted on the camshaft is provided so that the acceleration torque can be reduced. However, when the impact absorbent material or the decelerating material is provided to the apparatus, a configuration of the apparatus becomes complicated. In addition, it is necessary to consider a time degradation of the impact absorbent material or the decelerating material. Moreover, when the decelerating material is provided to the apparatus, the decelerating material is set up to apply the load to the cam or the reciprocating member in such a direction that the load torque is exerted on the camshaft even when the acceleration torque is exerted on the camshaft, so that the average load torque increases, and thus a power consumption also increases.

SUMMARY OF THE INVENTION

It is an object of the present invention to at least partially solve the problems in the conventional technology.

According to an aspect of the present invention, there is provided an image forming apparatus that employs electrophotographic technique to form an image on a recording medium. The image forming apparatus includes a reciprocating-motion converting mechanism that includes a cam that rotates around a rotation center; a reciprocating member that is reciprocated due to rotation of the cam, wherein a first load torque is generated by a load applied at a point of contact of the cam and the reciprocating motion member; and a pressing unit that presses the reciprocating member to the cam; and a load applying unit that applies a load to the cam to generate a second load torque, wherein a phase of the second load torque is substantially opposite to a phase of the first load torque.

The above and other objects, features, advantages and technical and industrial-significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
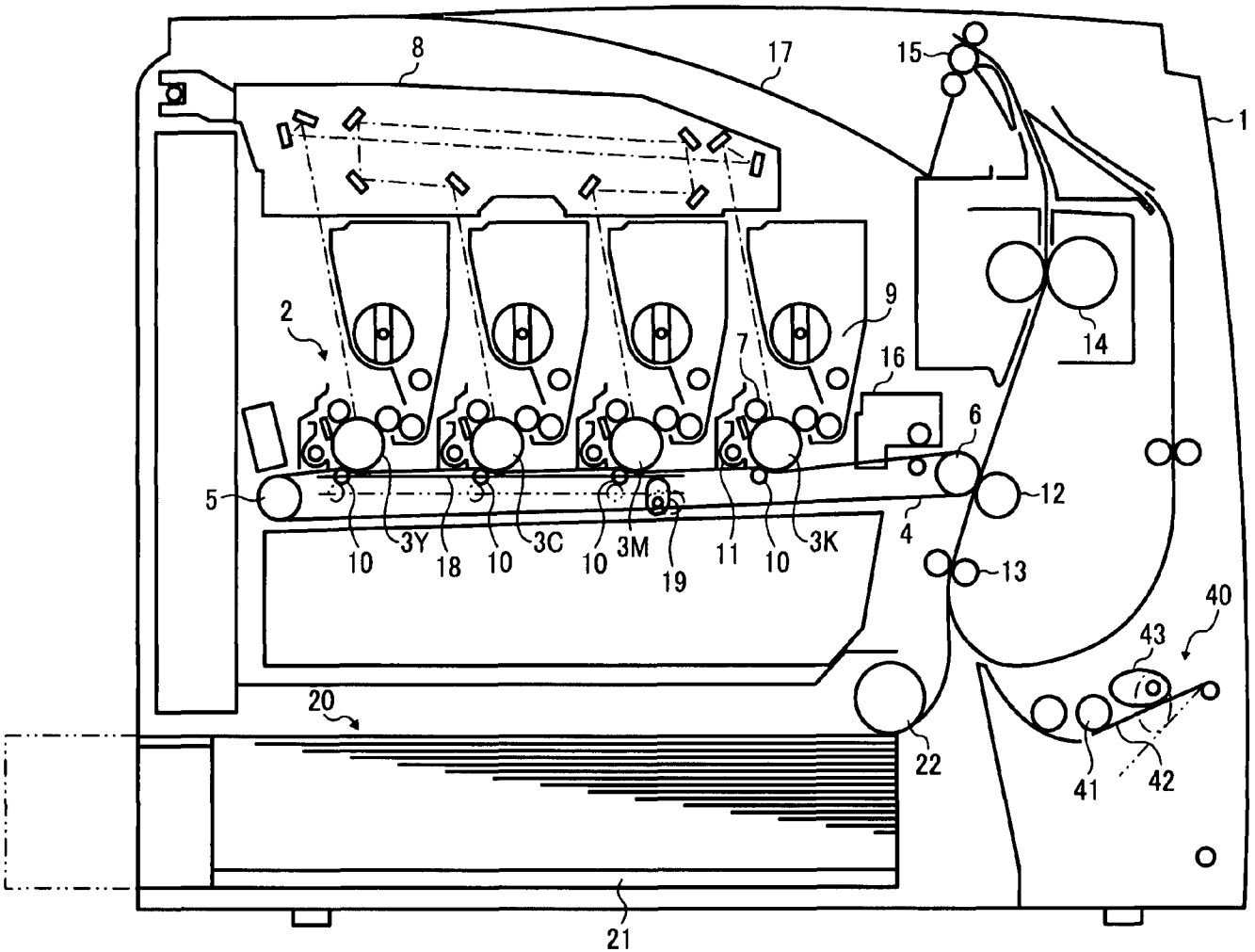
FIG. 1 is a schematic diagram of a color image forming apparatus according to an embodiment of the present invention.

FIG. 1 is a schematic diagram of a color laser printer as an example of an image forming apparatus according to an embodiment of the present invention.

As shown in FIG. 1, the color laser printer according to the embodiment is a tandem color laser printer. A main body 1 of the color laser printer includes four image forming units 2, an intermediate transfer belt 4 as an intermediate transfer body, supporting rollers 5 and 6, a laser scanning unit (LSU) 8, four transfer rollers 10, a secondary transfer roller 12, a pair of registration rollers 13, a fixing unit 14, a sheet discharging unit 15, a belt cleaning unit 16, a sheet stacking unit 17, a sheet feeding unit 20, and a manual sheet feeding unit 40. The image forming units 2 are arranged in the substantially center of the main body 1, and form yellow (Y), cyan (C), magenta (M), and black (K) color images, respectively. The sheet feeding unit 20 is arranged below the image forming units 2, and feeds a sheet on which an image is to be formed by the image forming units 2. The intermediate transfer belt 4 is a loop transfer belt supported by the supporting rollers 5 and 6, and is driven to rotate in a counter-clockwise direction in FIG. 1. Incidentally, the intermediate transfer belt 4 is used as the intermediate transfer body in the embodiment. Alternatively, a drum can be used instead of the intermediate transfer belt 4. The secondary transfer roller 12 is arranged to be opposed to the supporting roller 6 across the intermediate transfer belt 4.

Each of the image forming units 2 includes a photosensitive drum 3 (3Y, 3C, 3M, and 3K, respectively) as an image carrier, a charging unit 7, a developing unit 9, and a cleaning unit 11. The photosensitive drums 3Y, 3C, 3M, and 3K are tandemly-arranged above the intermediate transfer belt 4 with keeping a predetermined interval between each two of them, and Y, C, M, and K toner images are formed on surfaces of the photosensitive drums 3Y, 3C, 3M, and 3K, respectively.

Each of the photosensitive drums 3Y, 3C, 3M, and 3K is surrounded by the charging unit 7, the LSU 8, the developing unit 9, the transfer roller 10, and the cleaning unit 11. Each of the charging units 7 charges the surface of each of the photosensitive drums 3Y, 3C, 3M, and 3K. The LSU 8 exposes the surface of each of the photosensitive drums 3Y, 3C, 3M, and 3K to a laser beam corresponding to image data. Each of the developing units 9 develops an electrostatic latent image, which is formed on the surface of each of the photosensitive drums 3Y, 3C, 3M, and 3K by the exposure, into a toner image. The transfer rollers 10 are respectively arranged to be opposed to the photosensitive drums 3Y, 3C, 3M, and 3K across the intermediate transfer belt 4. Each of the cleaning units 11 removes a residual toner from the surface of each of the photosensitive drums 3Y, 3C, 3M, and 3K after the toner image is transferred onto the intermediate transfer belt 4.

A process of forming an image performed by the color laser printer is explained below. When the photosensitive drum 3 is driven to rotate in the clockwise direction in FIG. 1, the surface of the photosensitive drum 3 is charged to a predetermined polarity by the charging unit 7. The charged surface of the photosensitive drum 3 is exposed to a laser beam corresponding to image data by the LSU 8, whereby an electrostatic latent image is formed thereon. The electrostatic latent image formed on the surface of the photosensitive drum 3 is developed into a toner image by the developing unit 9. The toner image on the surface of the photosensitive drum 3 is transferred onto the intermediate transfer belt 4 by the application of pressure between the photosensitive drum 3 and the transfer roller 10.

In a case of forming a color image, the above process is performed by all the image forming units 2. Namely, Y, C, M, and K toner images on the photosensitive drums 3Y, 3C, 3M, and 3K are transferred onto the intermediate transfer belt 4 in such a manner that the Y, C, M, and K toner images are sequentially superimposed on the intermediate transfer belt 4.

The sheet feeding unit 20 includes a sheet tray 21 as a sheet containing unit, a sheet feeding roller 22, and a friction pad (not shown) as a separating unit. A recording medium, such as a transfer sheet or a resin film, (hereinafter, just "a sheet") is contained in the sheet tray 21. The sheet feeding roller 22 feeds the sheet contained in the sheet tray 21. If a plurality of sheets is fed by the sheet feeding roller 22, the sheets are separated by the friction pad to be fed one by one. The manual sheet feeding unit 40 includes a manual sheet feeding roller 41 and a bottom plate 42.

A sheet fed from the sheet feeding unit 20 or the manual sheet feeding unit 40 is conveyed toward the registration rollers 13. A leading end of the sheet is struck on the registration rollers 13 that are not driven to rotate at this time, so that a skew of the sheet is corrected. After that, the registration rollers 13 are driven to rotate at such a timing that the leading end of the sheet and the toner images transferred onto the intermediate transfer belt 4 get to the secondary transfer roller 12 at the same time. When the registration rollers 13 are driven to rotate at the timing, the sheet is conveyed toward the secondary transfer roller 12.

When the sheet passes between the supporting roller 6 and the secondary transfer roller 12, the toner images on the intermediate transfer belt 4 are transferred onto the sheet by the application of pressure between the supporting roller 6 and the secondary transfer roller 12. The sheet onto which the toner images are transferred is conveyed to the fixing unit 14, and the unfixed toner images are fixed on the sheet by the fixing unit 14. The sheet on which the toner images are fixed is conveyed to the sheet discharging unit 15, and discharged onto the sheet stacking unit 17 arranged on top of the main body 1 by the sheet discharging unit 15. After the toner images on the intermediate transfer belt 4 are transferred onto the sheet, the belt cleaning unit 16 removes transfer residual toners from a surface of the intermediate transfer belt 4.

On the other hand, in a case of forming a K monochromatic image, only a K toner image is formed on the photosensitive drum 3K, and the K toner image on the photosensitive drum 3K is transferred onto the intermediate transfer belt 4. Therefore, the photosensitive drums 3Y, 3C, and 3M are not required for forming the K monochromatic image, so that the intermediate transfer belt 4 is moved away from the photosensitive drums 3Y, 3C, and 3M by a reciprocating-motion converting mechanism. Specifically, the reciprocating-motion converting mechanism includes a link mechanism 18 and a cam 19. The link mechanism 18 is interlocked with the transfer rollers 10 that are opposed to the photosensitive drums 3Y, 3C, and 3M. The link mechanism 18 moves up and down in accordance with a rotation of the cam 19, so that the intermediate transfer belt 4 has contact with or moves away from the photosensitive drums 3Y, 3C, and 3M in accordance with the movement of the link mechanism 18. In this manner, the photosensitive drums 3Y, 3C, and 3M can avoid performing any unnecessary process, and it is possible to prevent the K toner image transferred onto the intermediate transfer belt 4 from having contact with the photosensitive drums 3Y, 3C, and 3M.

Such a reciprocating-motion converting mechanism is also provided in the manual sheet feeding unit 40. The manual sheet feeding unit 40 includes the manual sheet feeding roller 41, the bottom plate 42, and a cam 43. When a sheet is fed from the manual sheet feeding unit 40, the bottom plate 42 has contact with the manual sheet feeding roller 41, and the sheet is fed toward the secondary transfer roller 12 by passing between the bottom plate 42 and the manual sheet feeding roller 41. On the other hand, except when a sheet is fed from the manual sheet feeding unit 40, the bottom plate 42 is pressed to be retracted to a position as indicated by a dashed-two dotted line shown in FIG. 1 by a rotation of the cam 43 so that the bottom plate 42 is away from the manual sheet feeding roller 41. Therefore, it is possible to improve the user-friendliness in such a way that the user can easily take out a sheet from the manual sheet feeding unit 40, or insert a sheet into the manual sheet feeding unit 40.

Figure 2:
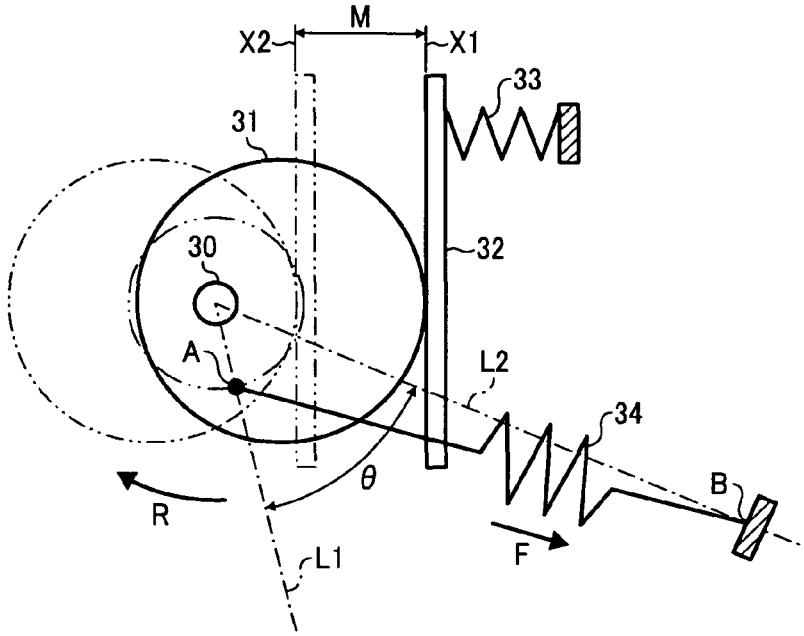
FIG. 2 is a schematic diagram of a reciprocating-motion converting mechanism employed in the color image forming apparatus according to the embodiment.

FIG. 2 is a schematic diagram of the reciprocating-motion converting mechanism employed in the color laser printer according to the embodiment.

The reciprocating-motion converting mechanism shown in FIG. 2 includes a cam 31, a reciprocating member 32, a load applying unit 33, and a load applying unit 34. The cam 31 is supported by a rotation shaft 30, and rotates around the rotation shaft 30. The reciprocating member 32 is interlocked with the cam 31.

The load applying unit 33 is composed of a spring and the like, and applies a load to the cam 31 via the reciprocating member 32 so that the reciprocating member 32 is held in a predetermined position within a movable area M of the reciprocating member 32 as a home position. In a case shown in FIG. 2, the load applying unit 33 is composed of a compression coil spring, and a load of the compression coil spring is exerted in such a way that the reciprocating member 32 is pressed to the side of the cam 31.

The load applying unit 34 is composed of a coil spring, and one end of the load applying unit 34 supports a point on the cam 31 as a load applied point A, and the other end of the load applying unit 34 is attached to a point on an infinite line L2 as a support point B. The load applied point A moves in a circle around the rotation shaft 30 in synchronization with a rotation of the cam 31. The infinite line L2 extends from the rotation shaft 30 and is tilted at an angle θ with respect to an infinite line L1 that extends from the rotation shaft 30 by passing through the load applied point A when the reciprocating member 32 is in a position X1, i.e., the farthest position from the rotation shaft 30 within the area M by the rotation of the cam 31. A load F is exerted in a direction from the load applied point A to the support point B as indicated by an arrow shown in FIG. 2.

When the cam 31 rotates by the application of a drive force from a drive source (not shown), a contact point between the cam 31 and the reciprocating member 32 moves depending on a shape of the cam 31, and the reciprocating member 32 is reciprocated between the position X1 and a position X2 where the reciprocating member 32 is in the nearest position to the rotation shaft 30 within the area M by the rotation of the cam 31. In this manner, the cam 31 converts the drive force into the reciprocating motion of the reciprocating member 32. Incidentally, an arrow R shown in FIG. 2 indicates a rotating direction of the cam 31.

Figure 3:
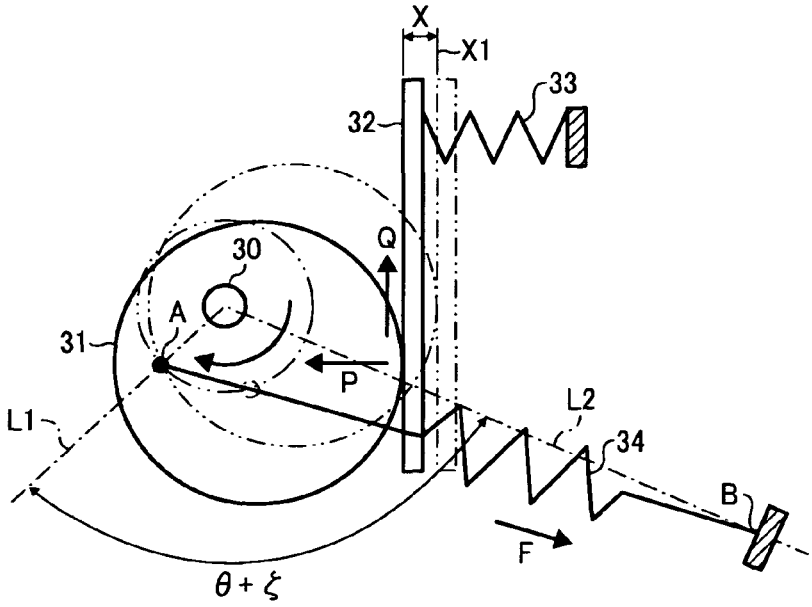
FIG. 3 is a schematic diagram for explaining a load torque exerted on a rotation shaft of a cam shown in FIG. 2.

Subsequently, a load torque exerted on the rotation shaft 30 of the cam 31 is explained below with reference to FIG. 3. When the cam 31 rotates around the rotation shaft 30 by a rotation angle ζ in the direction of the arrow R by the application of the drive force from the drive source (not shown), the reciprocating member 32 moves by a moving amount X from the position X1 to a position where the reciprocating member 32 has contact with the cam 31 depending on the shape of the cam 31. At this time, an external force P is applied to the cam 31 via the reciprocating member 32 by the load applying unit 33. The external force P and a frictional force Q are not directed toward the center of the rotation shaft 30 regardless of the shape of the cam 31, so that the external force P and the frictional force Q act as a moment around the rotation shaft 30. When a direction of application of the moment is opposite to the rotating direction of the cam 31, the moment becomes the load torque. On the other hand, when the direction of application of the moment is identical to the rotating direction of the cam 31, the moment becomes the acceleration torque. When an angle between the infinite line L1 and the infinite line L2 is "θ+ζ" in accordance with the movement of the load applied point A in synchronization with the rotation of the cam 31, the load F applied by the load applying unit 34 is exerted in the direction from the load applied point A to the support point B. At this time, the load F acts as a moment around the rotation shaft 30. When the direction of application of the moment is opposite to the rotating direction of the cam 31, the moment becomes the load torque. On the other hand, when the direction of application of the moment is identical to the rotating direction of the cam 31, the moment becomes the acceleration torque.

Figure 4:
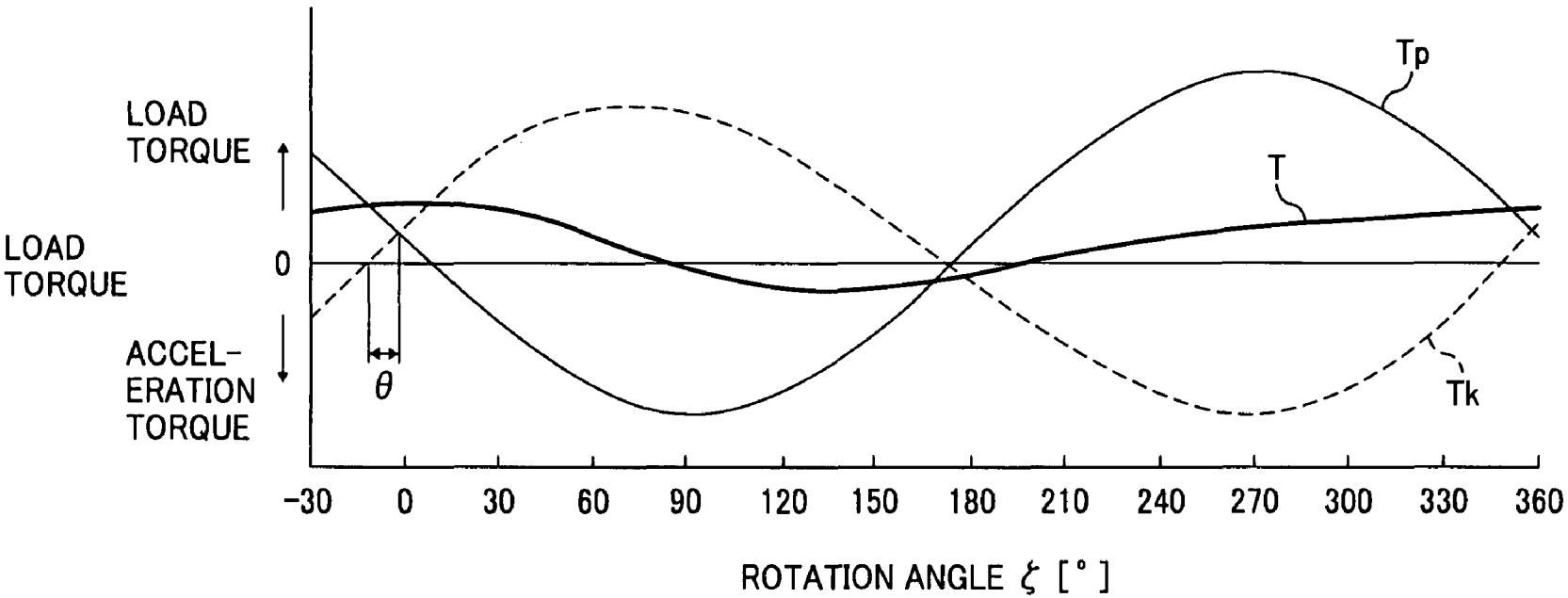
FIG. 4 is a graph for explaining a transitional change in the load torque exerted on the cam depending on a rotation angle of the cam.

A transitional change in the load torque exerted on the cam 31 depending on the rotation angle ζ is explained below with reference to a graph shown in FIG. 4. When the cam 31 rotates by the rotation angle ζ of 0° or 360°, the reciprocating member 32 is in the farthest position from the rotation shaft 30 within the area M. When the load torque is a positive value, the moment is exerted on the cam 31 as the load torque. On the other hand, when the load torque is a negative value, the moment is exerted on the cam 31 as the acceleration torque. First, a transitional change in a load torque that is caused by the external force P and the frictional force Q and exerted on the contact point between the cam 31 and the reciprocating member 32 (hereinafter, "load torque Tp") is explained below. It is assumed that the cam 31 starts rotating when the reciprocating member 32 is in the farthest position from the rotation shaft 30. As the cam 31 rotates, the load torque Tp is on a decreasing trend. When the load torque Tp falls to a negative value, the acceleration torque is exerted on the contact point. As the cam 31 further rotates, when the load torque Tp reaches the minimum point, the load torque Tp is on an increasing trend. Then, when the load torque Tp reaches the maximum point, the load torque Tp is again on a decreasing trend. When the cam 31 rotates by the rotation angle $\zeta$ of 360°, the load torque Tp indicates the same point as that is when the cam 31 rotates by the rotation angle $\zeta$ of 0°. When the load torque Tp indicates the maximum point, the maximum load torque is exerted on the contact point. When the load torque Tp indicates the minimum point, the minimum load torque is exerted on the contact point. Such a variation between the maximum load torque and the minimum load torque is referred to as a torque variation. Although a waveform indicating the torque variation of the load torque Tp has a different shape depending on the shape of the cam 31 or surface characteristics of the cam 31 at the contact point, in general, the maximum load torque is obtained when the reciprocating member 32 is in the farthest position from the rotation shaft 30 in accordance with the rotation of the cam 31, and the minimum load torque is obtained while the reciprocating member 32 moves away from the farthest position from the rotation shaft 30 in accordance with the rotation of the cam 31. Next, a transitional change in a load torque caused by the action of a load applied by the load applying unit 34 (hereinafter, "a load torque Tk") is explained below. It is assumed that the angle $\theta$ between the infinite line L1 and the infinite line L2 when the reciprocating member 32 is in the position X1, i.e., in the farthest position from the rotation shaft 30 is referred to as an initial phase displacement. In a waveform indicating a torque variation of the load torque Tk, the maximum load torque is obtained while the reciprocating member 32 moves away from the position X1 in accordance with the rotation of the cam 31, and the minimum load torque is obtained while the reciprocating member 32 moves towards the position X1 in accordance with the rotation of the cam 31. Therefore, the angle $\theta$ is set up within a range of −90° to 90°. In other words, when the reciprocating member 32 is in the position X1 in accordance with the rotation of the cam 31, the support point B is set up to be located on the infinite line L2 tilted at the angle $\theta$ around the rotation shaft 30 with respect to the infinite line L1, and an mount of the tilt is set up within a range of 0° to 90°. As a result, a phase of the torque variation of the load torque Tk is substantially opposite to that of the load torque Tp. A camshaft torque T is a composition of the load torque Tp and the load torque Tk. The load torque Tp and the load torque Tk are balanced out against each other, so that it is possible to reduce the torque variation and the maximum load torque.

With such a configuration of the reciprocating-motion converting mechanism, the intermediate transfer belt 4 is configured to have contact with or move away from the photosensitive drums 3Y, 3C, and 3M, and also the bottom plate 42 is configured to have contact with or move away from the manual sheet feeding roller 41. Therefore, with such a simple configuration, it is possible to prevent an occurrence of a noise such as an impact sound, and also to provide an image forming apparatus capable of preventing an increase of a power consumption.

Figure 5:
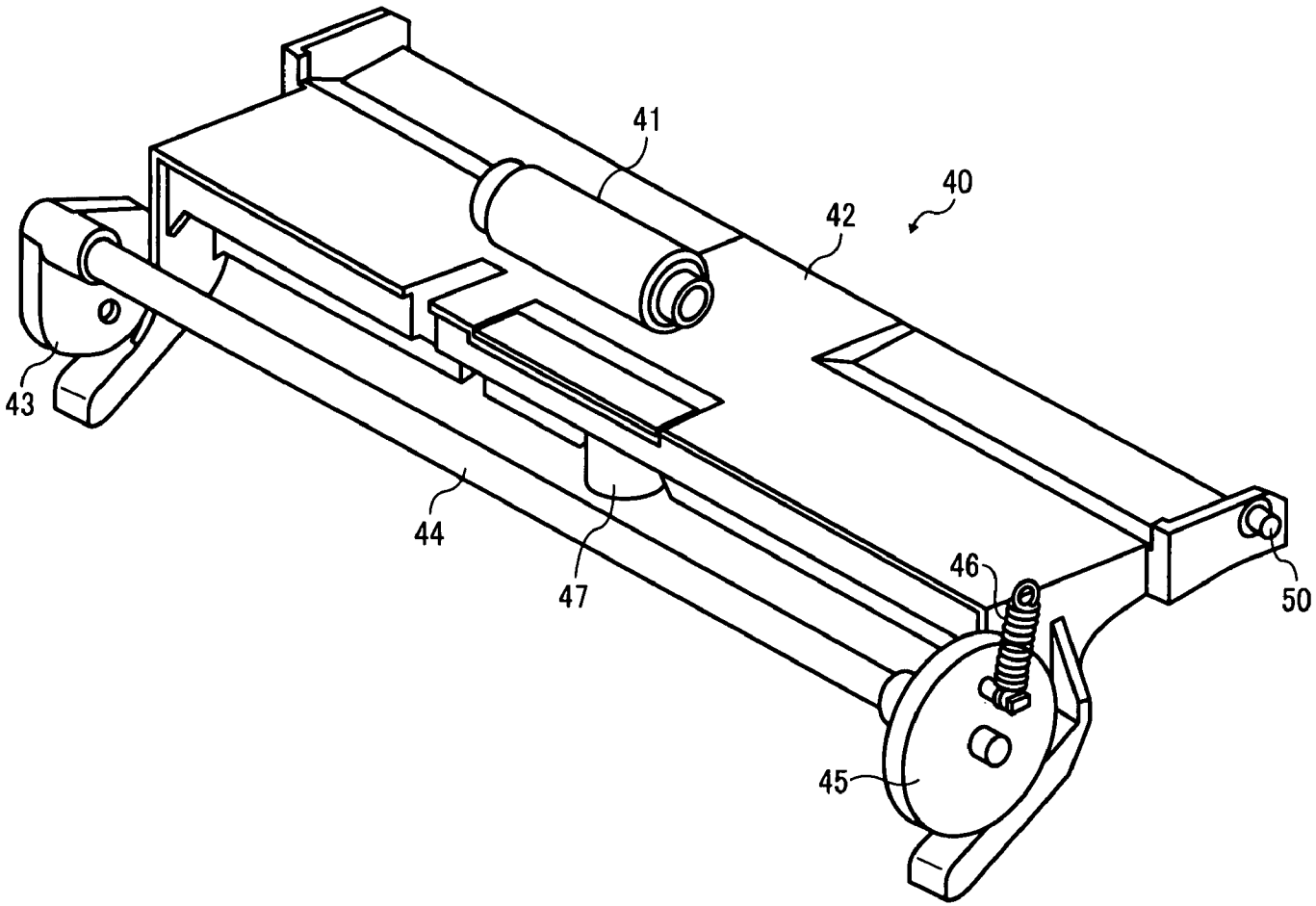
FIG. 5 is a perspective view of a manual sheet feeding unit including the reciprocating-motion converting mechanism.

FIG. 5 is a perspective view of the manual sheet feeding unit 40 in which the reciprocating-motion converting mechanism according to the embodiment is employed. The manual sheet feeding unit 40 includes the manual sheet feeding roller 41, the bottom plate 42, the cam 43, a rotation shaft 44, a rotating body 45, a load applying unit 46, and a load applying unit 47. The load applying unit 47 is set up to apply a load to the bottom plate 42 so that the bottom plate 42 has contact with the manual sheet feeding roller 41 firmly. When a recording medium is fed by the manual sheet feeding unit 40, the bottom plate 42 and the manual sheet feeding roller 41 have contact with each other firmly by the action of the load applied by the load applying unit 47. When the manual sheet feeding roller 41 is driven to rotate by a drive source (not shown), the recording medium is fed along a rotating direction of the manual sheet feeding roller 41. On the other hand, when a recording medium is not fed by the manual sheet feeding unit 40, the cam 43 is driven to rotate by a drive source (not shown). The bottom plate 42 rotates around a rotation shaft 50 of the bottom plate 42 by being pressed downward by the rotation of the cam 43, so that the bottom plate 42 moves away from the manual sheet feeding roller 41. Thus, it is possible to improve the user-friendliness in such a way that the user can easily take out a recording medium from the manual sheet feeding unit 40, or insert a recording medium into the manual sheet feeding unit 40.

As shown in FIG. 5, one end of the load applying unit, 46 supports an arbitrary point on the rotating body 45 (hereinafter, "a supported point"), and the other end of the load applying unit 46 is fixed to a point within an area other than a moving area of a sheet holding unit (not shown) or the like so that an angle between the rotation shaft 44 and the supported point is within a range of 0° to 90° when the bottom plate 42 is in the farthest position from the rotation shaft 44 in accordance with the rotation of the cam 43. With such a configuration, the load applying unit 46 can achieve an effect equivalent to that of the reciprocating-motion converting mechanism according to the embodiment. In addition, the load applying unit 46, which causes a camshaft torque, supports the rotating body 45 that rotates in synchronization with the cam 43 fixed to the rotation shaft 44, so that the effect of the load applying unit 46 can be exercised regardless of a shape and a size of the cam 43, an installation position of the cam 43 with respect to the rotation shaft 44 in a longitudinal direction, and a shape of the bottom plate 42.

Moreover, when the rotating body 45 is composed of a power transmission member, such as a gear or a timing pulley, the rotating body 45 not only can support the load applying unit 46, but also can transmit a drive force from a drive source (not shown) to the rotation shaft 44. Therefore, it is possible to make the configuration easier.

According to an aspect of the present invention, it is possible to obtain a substantially opposite phase to a phase of a variation of a load torque caused by a rotation of a cam by the use of a load applying unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that employs electrophotographic technique to form an image on a recording medium, the image forming apparatus comprising:

a reciprocating-motion converting mechanism that includes:

a cam that rotates around a rotation center;

a reciprocating member that is reciprocated due to rotation of the cam, wherein a first load torque is generated by a first load applied at a point of contact of the cam and the reciprocating member; and a pressing unit that presses the reciprocating member to the cam; and a load applying unit that applies a second load to the cam to generate a second load torque, wherein a phase of the second load torque is substantially opposite to a phase of the first load torque;

wherein the load applying unit applies the second load to a point of the cam as a load applied point, the load applied point moving in a circle around the rotation center of the cam in synchronization with the rotation of the cam, and wherein when the reciprocating member is in farthest position from the rotation center due to the rotation of the cam, the second load torque is exerted onto a point on a first infinite line that extends from the rotation center and is tilted around the rotation center within a range of 0 degrees to 90 degrees with respect to a second infinite line that extends from the rotation center by passing through the load applied point.

2. The image forming apparatus according to claim 1, wherein the load applying unit applies the second load directly to the cam.

3. The image forming apparatus according to claim 1, further comprising:

a rotating body that rotates integral with the cam;

wherein the load applying unit applies the second load to the rotating body.

4. The image forming apparatus according to claim 1, wherein the load applying unit is a spring.

5. The image forming apparatus according to claim 2, wherein the load applying unit is a spring.

6. The image forming apparatus according to claim 3, wherein the load applying unit is a spring.

7. The image forming apparatus according to claim 3, wherein the rotating body is a power transmission member.

8. The image forming apparatus according to claim 1, wherein the pressing unit is a spring.

9. The image forming apparatus according to claim 2, wherein the pressing unit is a spring.

10. The image forming apparatus according to claim 3, wherein the pressing unit is a spring.

11. The image forming apparatus according to claim 7, wherein the power transmission member is a gear.

12. The image forming apparatus according to claim 7, wherein the power transmission member is a timing pulley.

13. The image forming apparatus according to claim 1, wherein the load applying unit is a coil spring.

14. The image forming apparatus according to claim 3, wherein the load applying unit is a coil spring.

15. The image forming apparatus according to claim 1, wherein the pressing unit is a coil spring.

16. The image forming apparatus according to claim 3, wherein the pressing unit is a coil spring.

17. The image forming apparatus according to claim 1, wherein a magnitude of the first load torque depends on a shape of the cam.

18. The image forming apparatus according to claim 1, wherein a magnitude of the first load torque depends on a rotation angle of the cam.

19. The image forming apparatus according to claim 1, wherein a magnitude of the second load torque depends on a shape of the cam.

20. The image forming apparatus according to claim 1, wherein a magnitude of the second load torque depends on a rotation angle of the cam.

* * * * *